US005575534A

United States Patent [19]

Yu

[11] Patent Number: 5,575,534

[45] Date of Patent: Nov. 19, 1996

[54] WORK CHAIR

[75] Inventor: Chi-Yuang Yu, Hsinchu, Taiwan

[73] Assignee: Institute of Occupational Safety and Health, Council of Labor Affairs, Taipei, Taiwan

[21] Appl. No.: 491,629

[22] Filed: Jun. 19, 1995

[51] Int. Cl.[6] ..... A47C 7/02

[52] U.S. Cl. ..... 297/452.21; 297/452.19; 297/452.31; 297/337; 297/353

[58] Field of Search ..... 297/337, 353, 297/452.21, 452.30, 452.31, 452.19

[56] References Cited

U.S. PATENT DOCUMENTS

| | | | |
|---|---|---|---|
| 2,054,557 | 9/1936 | Cramer et al. | 297/353 |
| 2,692,012 | 10/1954 | Cramer | 297/353 |
| 4,690,459 | 9/1987 | Ullman | 297/452.21 |
| 5,035,466 | 7/1991 | Mathews et al. | 297/337 |
| 5,037,158 | 8/1991 | Crawford | 297/353 |
| 5,112,106 | 5/1992 | Ashjornsen et al. | 297/452.21 |

OTHER PUBLICATIONS

Catalog of the TB–S Series of work chairs for secretaries manufactured by Tatung Co., Taiwan.

*Primary Examiner*—Peter M. Cuomo

*Assistant Examiner*—Anthony D. Barfield

*Attorney, Agent, or Firm*—Bacon & Thomas

[57] ABSTRACT

A work chair comprising a backrest, a seat-pan, a fastening mechanism, and a support leg. The backrest is provided with a first fastening device. Theseat-pan comprises a pelvic support and a thigh support. The pelvic support is provided on the underside thereof with a rotary fastening unit and is further provided on a longitudinal median thereof with a second fastening device. The fastening mechanism comprises a vertical fastening portion engageable with the first fastening device of the backrest for adjusting the backrest upwards and downwards. The fastening mechanism further comprises a horizontal fastening portion engageable with the second fastening device of the seat-pan for adjusting the longitudinal depth of the seat-pan. The support leg is provided with a rotary fastening member engageable with the rotary fastening unit of the seat-pan. The thigh support of the seat-pan is arranged at an inclination ranging between 15 and 35 degrees in relation to the pelvic support of the seat-pan, so as to enable the trunk and the thighs of a person seated on the seat-pan to form an angle ranging between 100 and 120 degrees.

5 Claims, 17 Drawing Sheets

WORK CHAIR

FIELD OF THE INVENTION

The present invention relates generally to a work chair, and more particularly to a work chair for high mobility tasks designed in conformity with ergonomic principles.

BACKGROUND OF THE INVENTION

Work chairs are used ubiquitously by various workers in a variety of work places such as factory floors, offices, hospitals, etc. The nature of the work that a worker performs often requires the worker to sit on the work chair with a certain posture so as to get the job done efficiently. For example, bank clerks, typists and computer operators are required to sit on the work chairs with a certain posture for a prolonged period of time. As a result, the office workers are relatively vulnerable to various musculoskeletal disorders, some of which are often serious enough to call for an intensive medical attention or even surgical treatment. The medical costs, work lost and workers compensation for such disorders as mentioned above is so staggering that the annual cost can amount to billions of dollars in the United Stated alone.

It is generally believed by scholars and experts that the musculoskeletal disorders of the lower back are caused by demanding physical labor, such as lifting heavy objects. However, the epidemiological research shows that various musculoskeletal disorders of the lower back are often caused by improper sitting posture, and that the incident rate of such posture-related musculoskeletal disorders is by no means lower than that caused by demanding physical labor. According to the statistical data reported by Mogora in 1975, the incident rate of the nonsedentary workers ranges between 6% and 22% as compared with the incident rate of 10–14% of the sedentary workers. A research report, which was prepared and published by Rowe in 1983 on the basis of the diagnostic statistical data of the patients suffering from the musculoskeletal disorders of the lower back, showed that 41% of the patients studied are hard laborers and that 43% of the patients studied are sedentary workers. Another statistical report compiled by Liyd in 1986 showed that the incident rate of the lower back musculoskeletal disorders among miners is 69% as compared with the incident rate of 58% among the sedentary workers. The sum of the two statistical data referred in this research report is not 100% because some of the subjects were involved in both sedentary work and nonsedentary work.

The musculoskeletal disorders caused by the sitting posture include a pain in the lower back and a stiffness in the neck or shoulders. When a person is in a standing posture, his/her trunk-to-thigh included angle is 180 degrees while his/her spinal column bends in such a way that cervical vertebrae are lordotic (bending forward), thoracic vertebrae kyphotic (bending rearwards), lumbar vertebrae lordotic and sacral vertebrae kyphotic, as illustrated in FIG. 1. In other word, the best standing posture is formed by such spinal curvatures as described above. On the other hand, in a sitting posture, his/her trunk and thigh from an angle of 90 degrees, with the legs swiveling 90 degrees in relation to pelvis so as to bring about the extension of gluteus muscles and hamstring muscles. As a result, pelvis is caused to rotate rearwards by the muscular tension which is brought about by the extension of gluteus muscles and hamstring muscles, thereby causing lumbar vertebrae to straighten, as shown in FIG. 2. The straightening of lumbar vertebrae can bring about an asymmetrical pressure exerting on the intervertebral disc, a stretch of posterior ligaments of lumbar vertebrae, a muscular tension of erector spinae, and a strain on the central nervous system. For further illustration, please refer to FIGS. 3*a*–3*b*.

The straightening of lumbar vertebrae can bring about a pressure exerting asymmetrically on the nucleus of the intervertebral disc, which has a relatively thin rear edge and is therefore vulnerable to deformation and crack. In addition, the nucleus of the intervertebral disc is pushed by the asymmetrical pressure to squeeze the central nervous system, thereby resulting in a nerve pain or unconsciousness.

The tension of erector spinae can undermine its contractibility. As a result, a greater amount of energy is needed to avert the deformation of lumbar vertebrae. It is a well-known biological phenomenon that an excessive expenditure of body energy can cause a person to suffer from bodily fatigue.

When a person is in a standing posture, the posterior ligaments of his/her lumbar vertebrae are relaxed. However, the posterior ligaments are stretched, thereby increasing tension in these ligaments in a sitting posture. In order to help the person remain in the sitting posture, the tension may over-stretch and traumatize these ligaments and tear the attachments to the spinal processes.

When a person is seated, the tension on the lumbar spinal nerves increases due to a substantial increase in the length of the spinal canal. Accordingly, the nerves may be over-stretched and squeezed by the protuberances which may exist in the spinal canal. In addition, the peripheral nervous systems are also agitated by such stresses as described above such that the bodily fatigue is aggravated.

According to the study by Kapandji in 1974, the lumbar vertebrae are capable of bending forward to form an angle of 60 degrees in relation to pelvis in a standing posture. However, when a person is in a sitting posture, his/her pelvis must rotate backwards. In order to keep the upper portion of his/her body in an upright position while seated, his/her lumbar vertebrae must make a flexion of 35 degrees in relation to pelvis. As a result, the lumbar vertebrae are allowed to bend within the angular range of 25 degrees. For this reason, the scope of his/her activities is limited. In addition, a substantial amount of body energy is needed to sustain the contraction of muscles for remaining in the sitting posture. Under such circumstances as described above, the musculoskeletal disorders are easily developed or aggravated.

According to the study by Keegan (1953) who was an orthopedic surgeon, the extent to which the lumbar vertebrae straighten or bend rearwards is less serious when the trunk-thigh angle is changed from 180 degrees to 135 degrees, as illustrated in FIGS. 4*b*–4*c*. Keegan found that when the trunk-thigh angle is maintained at 135 degrees, the lumbar spine is in a neutral configuration with minimal musculoskeletal stresses. This finding was confirmed by studies conducted under zero-gravity conditions in space. The relaxed posture referred to above is the posture in which the trunk and the thighs form a 128-degree angle. In other words, the relaxed posture is similar in definition to the resting or normal posture in human anatomy. It is therefore suggested that the trunk-thigh included angle is an important factor capable of minimizing musculoskeletal stresses, and that the ideal angle is about 135 degrees. This implies that a good chair is one which is capable of preventing the pelvis of a person sitting thereon from swiveling rearwards so that a preferred spinal curvature is maintained. This is exemplified by the adjustable platform stool and the sit-stand stool, which are shown respectively in FIGS. 6*a* and 6*b*. Other examples include Mandal's high chair, Balan's chair designed jointly by Hog and Westonofa, Congleton's neutral chair, Opswik's saddle chair, and Palmgren's chair similar in shape to the bicycle seat. Such chairs as mentioned above are suitable for use by a teacher or bank teller by virtue of the fact that they allow a person sitting thereon to remain in a standing posture, and minimize the need of a sustaining force for keeping the person in the standing posture. It is readily conceivable that such chairs can not be used by a worker, such as a sewer, who has to use his/her leg to operate the machine. There are certain chairs which can cause a person sitting thereon to slide forward, thereby bringing about an unbearable shear force exerting on the hips of the person. There are also certain chairs cause the spine of a person sitting thereon to curve forward excessively, thereby producing a hollow in the back of the person. There are still certain chairs having a seat profile or a backrest profile which are so poorly designed that a person sitting thereon is not allowed to change sitting posture occasionally, thereby making the person very uncomfortable because of the poor ventilation effect.

For the purpose of better understanding of the present invention, some of the accompanying drawings are further expounded hereinafter.

FIG. 1 shows a schematic view of the spinal column of a person in a standing posture. The spinal column comprises cervical vertebrae 1, thoracic vertebrae 4, lumbar vertebrae 5, and sacral vertebrae 7. The pelvis is denoted by the reference numeral of 8. The reference numeral of 2 denotes that the cervical vertebrae 1 are lordotic while the reference numeral of 3 denotes that thoracic vertebrae 5 is kyphotic. In addition, the lumbar vertebrae 5 is shown to be lordotic, as denoted by the reference numeral of 6.

FIG. 2 shows a schematic view of the spinal column of a person in a sitting posture. The thighs are caused to rotate such that the hamstring muscles and the gluteus muscles are stretched to bring about tension, which causes pelvis to swivel rearwards and the spinal column to flex.

FIG. 3*a* is a schematic view illustrating that the lumbar vertebrae of a person are straightened when the person is in a sitting posture. The portion indicated by a circle 10 is enlarged, as shown in FIG. 3*b* in which an arrow 11 is intended to show that the lumbar vertebrae are straightened. In addition, arrows 12 and 13 are used to denote respectively that a force is exerted on the intervertebral disc asymmetrically, and that the posterior ligaments, the back muscles and the central nerve system are all stretched after the lumbar vertebrae are straightened.

FIGS. 4*a*–4*e* are schematic views showing respectively that angles of 200 degrees, 180 degrees, 135 degrees, 90 degrees and 50 degrees are formed by the trunks and the thighs. The curvatures of lumbar vertebrae are relatively small when the trunk-thigh angles are respectively 200, 180 and 135 degrees. However, the curvatures of lumbar vertebrae are substantially greater when the trunk-thigh angles are 90 and 50 degrees.

FIG. 5 is a schematic view of a normal or resting posture under zero-gravity conditions.

FIG. 6*a* is a schematic view of a high sitting posture, with the gluteal fold 10 being located right on the front edge of the seat, and with the ischial tvberosity 11 being located about 3–4 centimeters behind the front edge of the seat. The high sitting posture can cause the lower limbs to become numb because of the concentration of pressure on the gluteal fold 10. The pelvis, the hip joint and the femur are denoted respectively by the reference numerals of 8, 9 and 12. If the chair seat surface is extended forward and the extended portion is slanted downwards, as shown in FIG. 6*b*, the thighs will be located on the slanted extended portion and at the inclination of 20 degrees so that the pressure exerting on the vicinity of the gluteal fold can be minimized.

FIG. 7 shows a schematic view of the erect sitting posture and the slumped sitting posture which are denoted respectively by the reference numerals of 20 and 30. The ischial tuberosity 11 is used as a reference point in the illustration. In the erect sitting posture, the curve line of the posterior edge of the lumbar vertebrae is located near the ischial tuberosity. On the other hand, in the slumped sitting posture, the curve line of the posterior edge of the lumbar vertebrae is located farther from the ischial tuberosity. The lumbar support should be located between the two curve lines.

FIG. 8 shows a schematic view of the thoracic support. The erect sitting posture and the fully extended sitting posture are denoted respectively by the reference numerals of 81 and 82 while the posterior curve lines of the thorax of the erect sitting posture 81 and the fully extended sitting posture 82 are denoted respectively by the reference numerals of 811 and 821. An semi-extended sitting posture 83 is shown by dotted lines, with the posterior curve line of the thorax of the semi-extended sitting posture 83 being designated by the reference numeral of 831. The posterior curve line 831 is the ideal location at which the thoracic support should be located.

It is believed by other researchers and the inventor of this application that the trunk-thigh angle should be changed from 135 degrees to 110 degrees when the person remains in a high sitting posture under the influence of earth gravity. Being in such high sitting posture, the upper portion of the person's body can flex freely so as to perform work in a satisfactory manner. In addition, the incident rate of the musculoskeletal disorders is reduced. When a person is seated, the body weight is transmitted through the spine and the pelvis via the ischial tuberosity onto the seat. It is believed that the body weight can be supported effectively by the ischial tuberosity in a sitting posture. It has been shown by Swearington that a total area of 98 cm2 (49 cm 2 each side) around the ischial tuberosities is capable of supporting 50 percent of the weight of the total body.

The ischial tuberosities are the most prominent anatomic landmark in the seated posture, and, therefore, are proposed as reference points for seat-design. Because they are the weight-bearing points in a seated posture, their position on the seat can be easily identified. Furthermore, they act as the stationary pivot axis for the pelvic rotation which occurs during posture changes, such as when moving from a slumped sitting posture to an erect sitting posture.

The seat-pan for a sitting posture should consist of two contour support surfaces, a pelvic support and a thigh support to accommodate the geometry of the pelvis and the femur. The pelvic support should be small because it only supports the area of the buttocks posterior to the gluteal fold. This pelvic support provides a horizontal platform for the ischial tuberosities to support the majority of the body weight in an upright direction. Although the pelvic support can be used alone, there may be excessive pressure on the gluteal folds since the thighs are not supported. Therefore, it is proposed that an extension of the pelvis support be provided to support the thighs at the appropriate angle and to distribute the pressure over a large area. This thigh support should not be so deep (i.e. long) and may be at the inclination of 20 degrees.

In addition to the seat-pan of the chair, the natural curvature of human spinal column should be taken into consideration in the process of designing a work chair. It is imperative that stress exerting on the spinal column should be reduced or eliminated, and that a good backrest should be provided so as to enable lumbar vertebrae to flex properly without resorting to the contraction force of the erector spinae.

As shown in FIG. 6*a*, the ischial tuberosity is generally located about 3–4 cm away from the front edge of the seat-pan. While sitting in the proposed posture, a person can change from a slumped sitting posture to an erect sitting posture by pivoting the pelvis on the ischial tuberosity. The position of ischial tuberosity is fixed so that it can be used as a reference point for designing the backrest of a work chair. The horizontal distance between the lumbar vertebrae and the ischial tuberosity is largest in the slumped sitting posture. On the other hand, the horizontal distance between the lumbar vertebrae and the ischial tuberosity is smallest in the erect sitting posture, as shown in FIG. 7. It is therefore possible that a good lumbar support can be designed on the basis of the space and the movement range of these two spinal curvatures and the ischial tuberosity. A lumbar support is located at the middle line of these two curvatures, with the movement range serving as a horizontal adjustment distance of the lumbar support. The shape, the horizontal distance, vertical height and curvature radius of the lumbar support are dependent on the data of the measured curve lines.

The lumbar support can be extended upwards so as to provide the thoracic vertebrae with a support. However, the upper edge of the thoracic support should be at the level of the seventh thoracic vertebra (T7). If this edge is to low, it does not provide enough support; in contrast, if it is higher than T7 vertebra, it will contact the inferior angles of the scapular and cause discomfort. Therefore, the location of T7 should be the upper edge of the thoracic support. When the lumbar support is ideally located, the worker seated on the chair can change postures from an erect sitting posture to a fully extended sitting posture by leaning backwards against the support. A thoracic support should be placed between these two extreme curves. If a thoracic support is located along the erect spinal curve, it will interfere too much with required torso motions. If a thoracic support is located along the fully extended curve, it will not provide sufficient support during normal backward extension. Between these two boundary curves, a semi-extended curve can be traced and used as a reference for the thoracic support. It must be noted that the lumbar support is the primary structure which supports the lumbar spine during task performance to prevent backward rotation of the pelvis and to preserve the lumbar lordosis; the thoracic support is a secondary structure which supports the upper back during periodic backward leaning.

The seat-pan of a work chair must be provided with two functional units, a pelvic support and an thigh support, so as to enable a worker sitting on the Work chair to remain in a high sitting posture. Similarly, the backrest of a work chair must be provided with two functional units comprising a lumbar support and a thoracic support.

SUMMARY OF THE INVENTION

It is therefore the primary objective of the present invention to provide a work chair which is designed in conformity with ergonomic principles so as to enable a worker sitting on the work chair to remain active and in a high sitting posture.

It is another objective of the present invention to provide a work chair with a narrow backrest having an arcuate surface.

It is still another objective of the present invention to provide a work chair with a seat having therein an anti-skidding means.

It is still another objective of the present invention to provide a work chair with a seat-pan having a specifically-angled area.

It is still another objective of the present invention to provide a work chair enabling a worker sitting thereon to remain in a high sitting posture with a narrow longitudinal depth.

It is still another objective of the present invention to provide a work chair capable of preventing a worker sitting thereon from remaining in a poor sitting posture through which the worker is susceptible to bodily fatigue.

It is still another objective of the present invention to provide a work chair capable of improving the working efficiency of a worker sitting thereon.

In the specification of the present application, the word "horizontal" refers to the direction that is parallel to the pelvic support of the work chair while the word "perpendicular" is used to denote the direction which is perpendicular to the pelvic support of the work chair. The word "upwards" is used to denote a direction from the support leg of the work chair toward the pelvic support of the work chair while the word "downwards" means a direction which is opposite to the upward direction described above. In addition, the word "forward" is used to refer to a direction toward the thigh support from the pelvic support of the work chair of the present invention. On the other hand, the word "rearwards" is used in the specification of the present application to denote a direction that is opposite to the above-mentioned forward direction.

The work chair of a first embodiment of the present invention comprises a backrest, a seat-pan, a fastening mechanism, and a support leg.

The backrest is provided on the back thereof with a first fastening means.

The seat-pan comprises a pelvic support and an thigh support. Located centrally on the underside of the pelvic support is a rotary fastening unit. The pelvic support is provided with a second fastening means located on a longitudinal center line thereof.

The fastening mechanism is composed of a vertical fastening portion and a horizontal fastening portion, which are joined together at an angle ranging between 85 and 95 degrees. The vertical fastening portion is intended to connect with the first fastening means of the backrest while the horizontal fastening portion is fastened with the second fastening means of the seat-pan.

The support leg is provided with a rotary fastening member engageable with the rotary fastening unit of the seat-pan.

The work chair of the present invention is characterized in that said backrest is provided integrally with a thoracic support and a lumbar support, said lumbar support has an arcuate construction at a front side facing a person's back who is sitting on said work chair, and said thoracic support is inclined at an inclination ranging between 15 and 25 degrees in a direction away from said seat-pan.

The lumbar support is used to support the lumbar spine of a worker sitting on the work chair while the thoracic support is intended to support intermittently the upper back the worker at such time when the worker reclines. The thoracic support enables the worker to recline without contracting his/her lumbar muscles. As a result, an appropriate spinal curvature of the worker is upheld when the worker reclines. Said arcuate construction preferably has an arcuate profile in both vertical and horizontal directions. The curve line radius of said arcuate construction of the lumbar support ranges between 8 and 15 centimeters, preferably 9 and 12 centimeters. The portion of the lumbar support at the apex of the arcuate construction has a thickness ranging between 5 and 12 centimeters, preferably 8 and 10 centimeters. The thoracic support is extended upwards along the curve line of the lumbar support such that the thoracic support and the plummet form a extendedangle ranging between 10 and 30 degrees, preferably 15 and 25 degrees. The backrest is of a small-sized construction having a width in the range of 15 to 30 centimeters, preferably 20 to 25 centimeters, and further having a maximum length ranging between 20 and 40 centimeters, preferably 25 and 35 centimeters.

The seat-pan of the work chair of the present invention has a longitudinal length ranging between 35 and 45 centimeters and similar to the longitudinal length of the prior art.

The fastening mechanism of the work chair of the present invention is similar in construction to the fastening mechanism of the prior art work chair and is provided with an L-shaped connection rod. The vertical fastening portion of the fastening mechanism of the present invention is fastened with the first fastening means of the backrest by screws or rivets such that the backrest can be adjusted upwards or downwards. For example, a suitable fastening mechanism can be seen in TB-S Series of work chairs for secretaries manufactured by TATUNG Co., Taiwan. The backrest can be adjusted upwards and downwards in the range of 20 to 40 centimeters measured from the seat-pan to the apex of the arcuate construction, depending on the need and the height of a user.

The horizontal fastening portion of the fastening mechanism of the work chair of the present invention is fastened with the second fastening means of the seat-pan by screws or rivets such that the longitudinal depth of the seat-pan can be adjusted, as exemplified by TATUNG TB-S Series of work chairs. It is preferable that the longitudinal depth of the seat-pan can be adjusted in the range of 15 to 30 centimeters, depending on the need and the body size of a user.

The support leg of the work chair of the present invention is similar in construction to the support leg of the prior art work chair and is rotatable. The support leg of the present invention is provided at the bottom thereof with a leg base having a plurality of casters fastened thereto. The rotary fastening member of the support leg is fastened with the rotary fastening unit of the seat-pan by any conventional means such that the level of the seat-pan can be adjusted, as exemplified by TATUNG TB-S Series of work chairs.

It is recommended that the distance between the seat-pan and the bottom of the support leg ranges between 40 and 60 centimeters.

The work chair of a second preferred embodiment of the present invention comprises a backrest, a seat-pan, a fastening mechanism, and a support leg.

The backrest is provided on the back thereof with a first fastening means.

The seat-pan comprises a pelvic support and an thigh support. The pelvic support is provided centrally on the underside thereof with a rotary fastening unit and is further provided on the longitudinal center line thereof with a second fastening means.

The fastening mechanism is composed of a vertical fastening portion and a horizontal fastening portion, which are fastened at an angle in the range of 85 to 95 degrees. The vertical fastening portion is engageable with the first fastening means of the backrest while the horizontal fastening portion is engageable with the second fastening means of the seat-pan.

The support leg is provided at the top end thereof with a rotary fastening member engageable with the rotary fastening unit of the seat-pan.

The pelvic support of the seat-pan of the work chair of the present invention has a longitudinal depth ranging between 15 and 30 centimeters. The thigh support of the seat-pan has an inclination ranging between 15 and 35 degrees in relation to the pelvic support. As a result, the trunk and the thighs of a worker sitting on the work chair form an angle of 100 degrees or so. In addition, the seat-pan of the work chair of the present invention is provided with an anti-skidding means located at or near the junction between the pelvic support and the thigh support.

The backrest of the work chair of the second preferred embodiment of the present invention can be similar in construction to the backrest of the prior art work chair, but preferably is similar in construction to the backrest of the first preferred embodiment of the present invention.

Preferably, the pelvic support of the work chair of the present invention is slightly inclined toward the backrest and has a longitudinal depth ranging between 15 and 30 centimeters, preferably 20 and 25 centimeters. The thigh support of the seat-pan has an inclination ranging between 15 and 35 degrees, preferably 20 and 25 degrees in relation to the pelvic support. The anti-skidding means is capable of locating the ischial tuberosity of a worker sitting on the work chair. The anti-skidding means of the work chair of the present invention is similar in construction to the anti-skidding means of the prior art work chair. As the thigh support has an inclination in the range of 15 to 35 degrees, the trunk and the thighs of a worker sitting on the work chair can form an angle ranging between 100 and 120 degrees.

The anti-skidding means of the seat-pan of the present invention is preferably similar in construction to an anti-skidding baffle having a ridged cross section, with the ridged edge line being located about 1–2 centimeters, preferably 1.2–1.6 centimeters, higher than the junction line between the pelvic support and the thigh support.

The fastening mechanism of the support leg of the second preferred embodiment of the present invention is similar in fastening method to the fastening mechanism of the support leg of the first preferred embodiment of the present invention.

The work chair of a third preferred embodiment of the present invention comprises a backrest, a seat-pan, a fastening mechanism, and a support leg.

The backrest is provided on the back thereof with a first fastening means.

The seat-pan is made up of a pelvic support and an thigh support. The pelvic support is provided centrally on the underside thereof with a rotary fastening unit and is further provided on the longitudinal center line thereof with a second fastening means.

The fastening mechanism is composed of a vertical fastening portion and a horizontal fastening portion, which form an angle ranging between 85 and 95 degrees. The vertical fastening portion and the horizontal fastening portion are engageable respectively with the first fastening means of the backrest and the second fastening means of the seat-pan.

The support leg is provided at the top end thereof with a rotary fastening member engageable with the rotary fastening unit of the seat-pan.

The backrest is fastened with the fastening mechanism such that the backrest can be adjusted upwards and downwards. The seat-pan is fastened with the fastening mechanism such that the seat-pan can be adjusted in its longitudinal depth. The backrest is of a small-sized construction and is provided with an arcuate surface. The thigh support of the seat-pan has an inclination ranging between 15 and 35 degrees in relation to the pelvic support, so as to enable the trunk and the thighs of a worker sitting on the chair to form an angle ranging between 100 and 120 degrees. The seat-pan is provided with an anti-skidding means located at or near the junction of the pelvic support and the thigh support.

The method and the means by which the backrest, the sitting portion and the leg of the work chair of the third preferred embodiment of the present invention are similar to those of the first preferred embodiment of the present invention. In addition, the backrest and the seat-pan of the third preferred embodiment of the present invention are made in accordance with the special design which was described previously in this specification.

The embodiments of the present invention described above are also based on the following twelve basis sizes obtained in an experiment conducted by this inventor of the present invention, as shown in FIG. 9:

(a) depth—pelvic support (b) location—ischial tuberosity (c) depth—thigh support (d) angle—thigh support (e) vertical length—lumbar support (f) radius—lumbar support (g) horizontal distance—lumbar support (h) horizontal adjustment—lumbar support (i) vertical height—lumbar support (j) vertical length—thoracic support (k) angle—thoracic support (l) angle adjustment—thoracic support In the experiment, a total of 64 subjects were studied, with 3 of the 64 subjects being male and with the rest being female. The 64 subjects were college students and staff members, and factory workers, with their ages ranging between 20 and 42. The heights of the subjects range between 147 and 191.5 centimeters, with the average height being 158.1 centimeters. The weights of the subjects range between 45 kilograms and 83 kilograms, with the average weight being 50.2 kilograms. Two of the males have a body size larger than 95% of the randomly sampled males. Two of the females have a body size smaller than 5% of the randomly sampled females. The tested subjects having a body size above the ninety fifth percentile and lower than the fifth percentile are for better understanding of the possible extreme sizes of the work chair. None of the subjects has had any spinal disorder in the past.

The main measuring device used in the experiment was the 3-dimensional spinal curvature measurement device capable of graphing rapidly a spinal curvature and its coordinates. The device makes use of the principle of polar coordinates to measure the point coordinates (L, θ, ϕ) in the space. L stands for distance; θ for the angle of horizontal rotation; ϕ for the angle of elevation. Two high precision 300° potentiometers and a high precision ring 10-turn potentiometer were used as analog transducers in the experiment. The analog signal polar coordinate was converted into the digital polar coordinate by an analog-to-digital converter. The digital polar coordinate was then converted by a computer into a perpendicular coordinate (x, y, z). The three dimensional spinal curvature measurement device described above is capable of reading the coordinates of single point as well as a plurality of space curve lines which are graphed continuously. The graphing precision of the device is within 0.3 mm. As a result, the device is suitable for use in graphing the human spinal curvature.

The secondary devices used in the experiment include an ischial seat, a pelvic support measurement device, a bike seat, and a lumbar support. The ischial seat was used to locate the ischial tuberosity of a subject. The ischial seat has a seat-pan provided with a groove containing therein clay. When a subject was seated on the seat-pan, two folds of the subject's ischial tuberosity were printed on the clay. The folds were then used as reference points for measuring the space position of the spinal column. The pelvic support measurement device was used in the experiment for measuring the depths of the folds of ischial tuberosity, the front edge of the chair and the rear sides of hips. The bike seat was used in the experiment to study the relationship between the spinal curve of a standing posture and the ischial tuberosity. The lumbar support was used in the experiment to measure the spinal curves of a fully extended sittingposture and a semi-extended sitting posture. The lumbar support was provided in the middle thereof with a slit to facilitate the measuring process.

As a subject was ready for testing, the spinal process and the posterior thigh were marked before the ischial seat and the pelvic support measurement device were adjusted. The thighs of the subject were required to remain at an inclination of 20 degrees, with the subject's upper arms being perpendicular to the subject's shoulders, and with the subject's eyes staring at a picture placed on a table such that the picture was separated from the subject's eyes by a distance of 40 centimeters. Such a posture as described above was repeated before the subject was asked to remain in an erect sitting posture. Twenty two spinal vertebrae were marked. In the meantime, a line was set up on the posterior thigh curve between the gluteal fold and the popleteal.

The pelvic support measurement device was employed to measure the depth-pelvic support and the reference point position. The subject was asked to sit on the soft clay such that the gluteal fold of the subject was aligned with the front edge of the pelvic support. A vertical metal plate was used to touch the most extended portion of the hip. The longitudinal depth of the hip is the distance between the metal place and the front edge of the pelvic support. The subject was asked to arise. The ischial tuberosity of the subject was printed on the clay on which a drop of water was deposited. A mark was made when the water drop reached the deepest point of the recessed print of the ischial tuberosity. The distances between the recessed print and the front edge of the pelvic support measurement device were measured. The position of the pelvic support reference points was determined by taking the average of these two distances. Such a process as described were repeated twice.

Before the posterior thigh curve was graphed, each of the subjects was asked to sit on the ischial seat. The curve was graphed by means of the 3-D spinal curvature measurement device. Before the measurement was taken again, all equipment was inspected to ensure that the ischial seat was full of clay and that the three dimensional spinal curvature measurement device was calibrated. The subject was asked to remain in an erect sitting position. The twelve marks on the thighs were graphed by the 3-dimensional spinal curvature measurement device. Such data were fed into a computer. The subjects were asked to arise for measuring the reference points of two recessed prints of the ischial tuberosity. The water drops were introduced into the recessed prints before taking measurements by 3-D spinal curvature measurement device. The reference point of the two recessed prints were determined by the computer. On the basis of new reference point, a new coordinate system was established. The twelve marks of the thighs were transferred to the new coordinate system by the computer and were stored for analysis in the future. Such a measuring process as described above was repeated twice.

The method of measuring five spinal curves is similar to that for measuring the curves of posterior thighs. Twenty two marks on the spinal column were graphed by 3-D spinal curvature measurement device. The spinal curves of a standing posture, an erect sitting posture, a slumped sitting posture, a fully extended sitting posture, and a semi-extended sitting posture were measured. The spinal curve of the standing posture was graphed by using a device similar to a bike seat which can be adjusted to support the subject's buttocks. The spinal curves of the erect sitting posture and the slumped sitting posture were graphed by using the ischial seat. The spinal curves of the fully extended sitting posture and the semi-extended sitting postures were graphed by using the ischial seat and the lumbar support. The size, the curvature radius and the position of the lumbar support of the seat-pan were determined on the basis of the measured spinal curves of the standing posture, the erect sitting posture and the slumped sitting posture.

For each subject of the experiment, the spinal curves (erect sitting posture, standing posture, slumped sitting posture, fully extended sitting posture and semi-extended stting posture) and one posterior thigh curve were measured. On the basis of such vital data, design of the seat-pan and the backrest of the work chair of the present invention can be determined. The data of six curves were printed on a sheet of paper by using the ischial tuberosity as the reference point, as shown in FIG. 10.

The analysis of the positions of the reference point was conducted, using descriptive and correlative statistics. The amplitude of the reference point (the distance between the ischial tuberosity and the front edge of pelvic support) ranges between 2.7 and 5.2 centimeters, with the average being 4.1 centimeters, and with the standard deviation being 0.6 centimeter. As far as a subject is concerned, the correlative coefficient of the data obtained in two repeated measurements was 0.6. The measurement deviation amplitude ranges between 0.1 and 1.2 centimeters, with the average being 0.5 centimeter, and with the standard deviation being 0.4 centimeter. On the basis of regressive analysis, the relationship between body type and size is insignificant.

The work chair of the present invention is designed on the basis of such data as the size average value, the standard deviation, the fifth percentile, the fiftieth percentile, the ninety fifth percentile, etc., as shown in Table 1. The recommended values in Table 1 was determined on the basis of the principle of ergonomics, with the fifth percentile being the minimum recommended value. This means that the values are suitable for persons having body sizes over the fifth percentile.

The data of the spinal curves (the erect sitting posture, the fully extended posture, the slumped sitting posture, the semi-extended sitting posture and the standing posture) and the posterior thigh curves of the experiment are shown in FIG. 10. The units of the longitudinal axis and the horizontal axis are both in centimeter. The average height of the subjects is 166 centimeters.

DETAILED DESCRIPTION OF THE EMBODIMENTS

Figure 1:
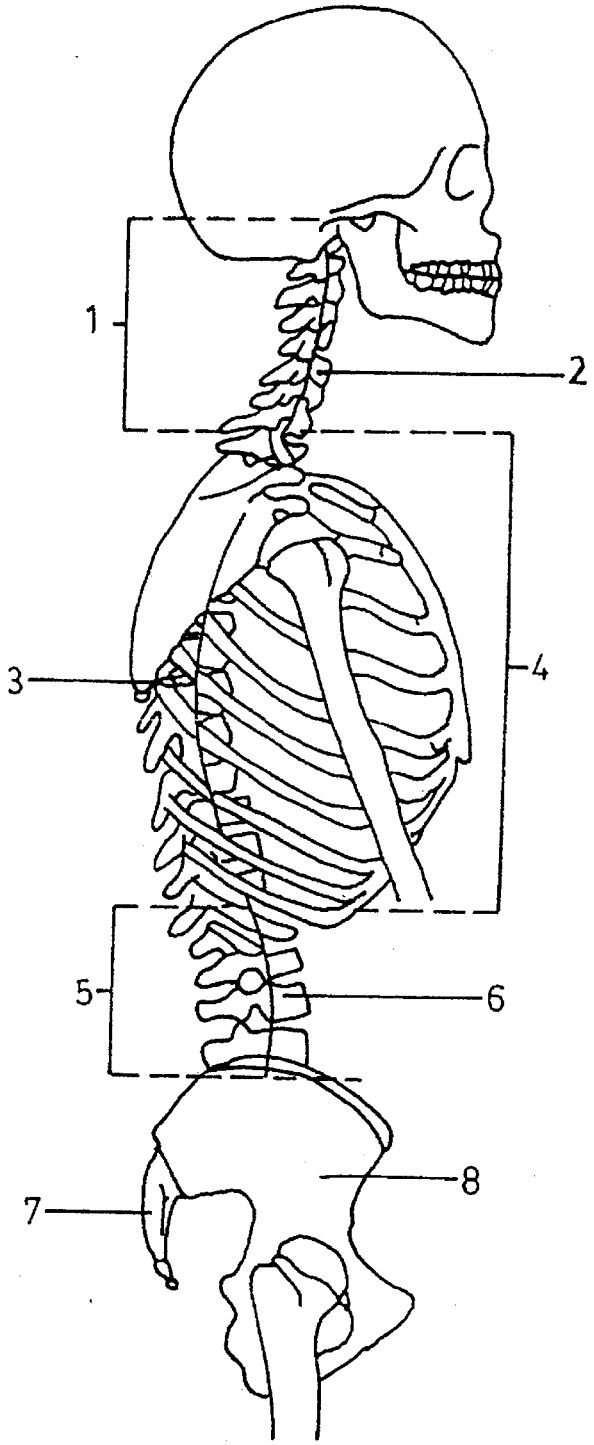
FIG. 1 is a schematic view showing the relative positions of the spinal column and the pelvis of a person in a standing posture.
Figure 2:
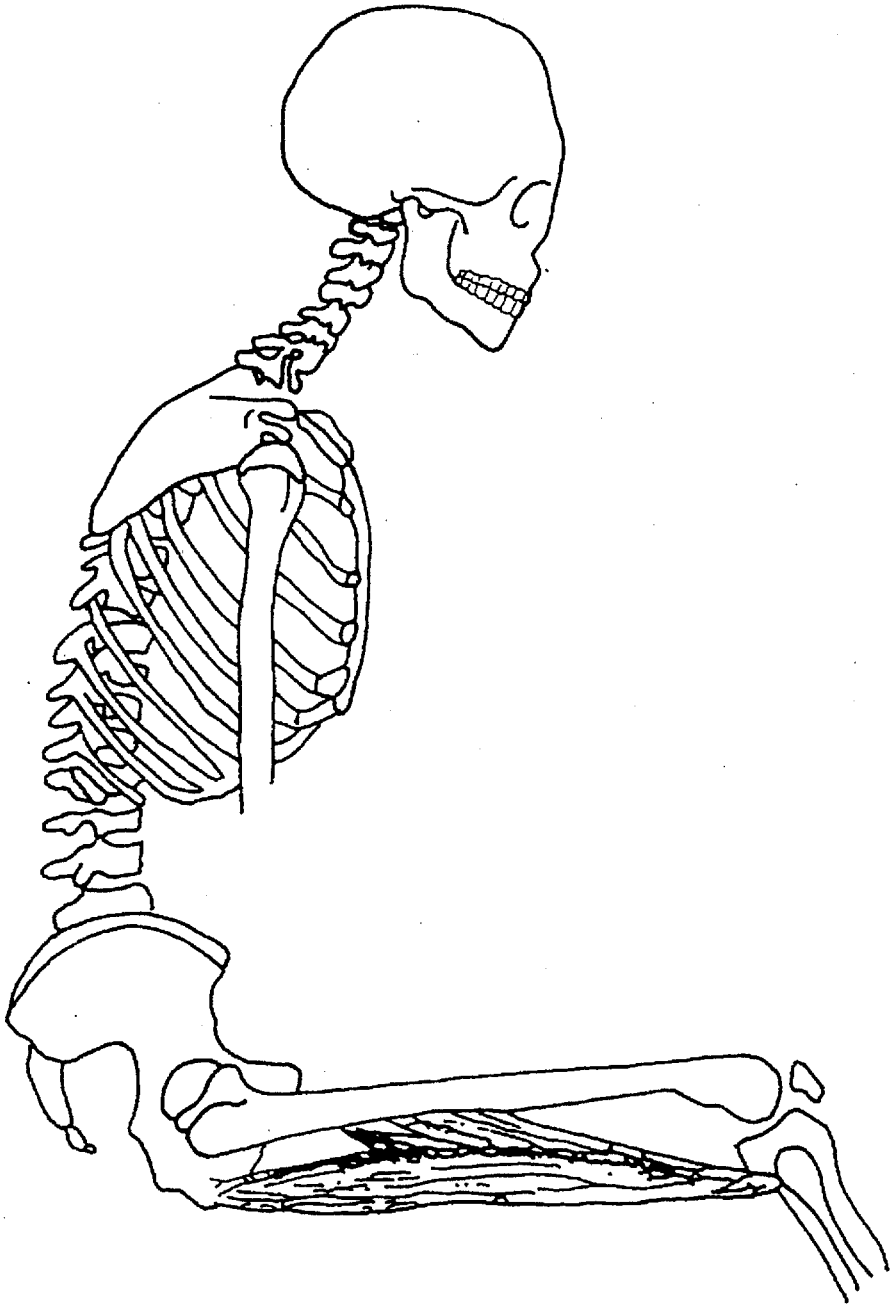
FIG. 2 is a schematic view showing the relative positions of spinal column, pelvis, femur, and hamstring muscles of a person in a sitting posture.
Figures 3A, 3B:
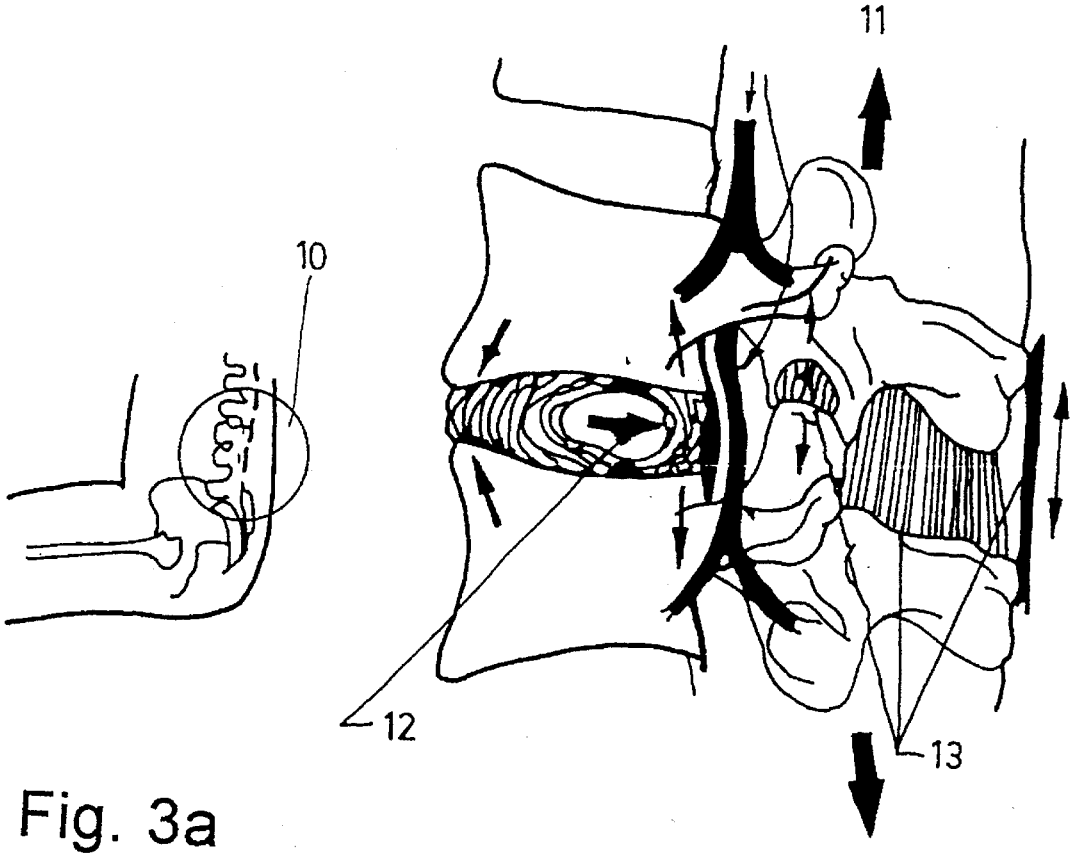
FIGS. 3*a* and 3*b* are schematic views showing that the lumbar vertebrae of a person in a sitting posture are straightened.
Figures 4A, 4B, 4C, 4D, 4E:
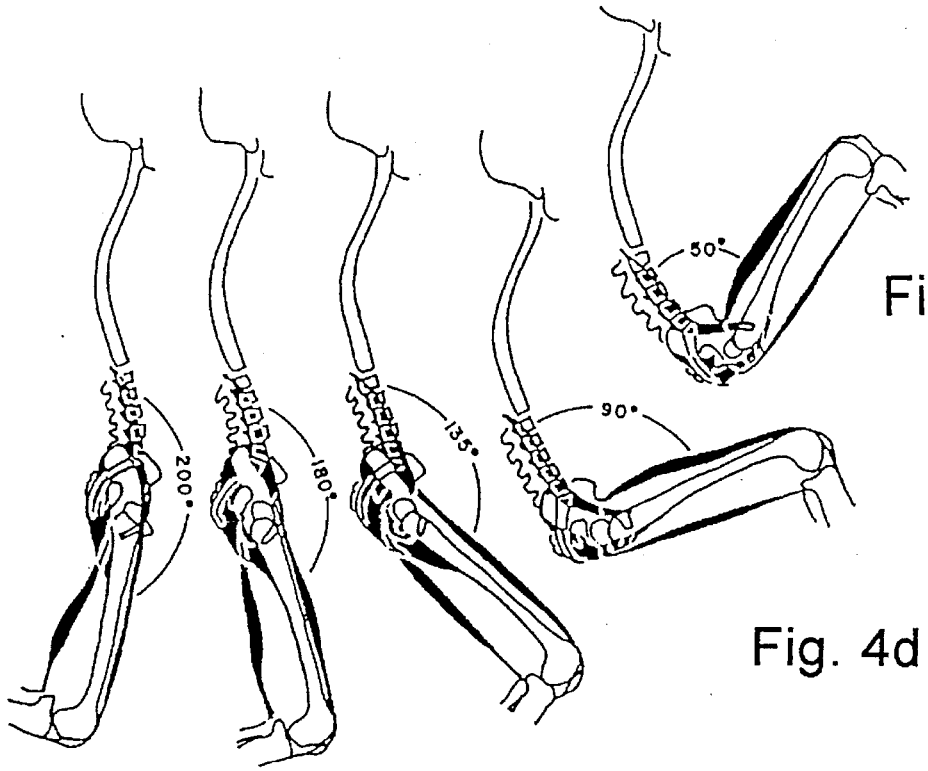
FIGS. 4*a*–4*e* are schematic views showing that the lumbar vertebrae are deformed in various ways in conjunction with various changes in the angle formed by the trunk and the thighs of a person.
Figure 5:
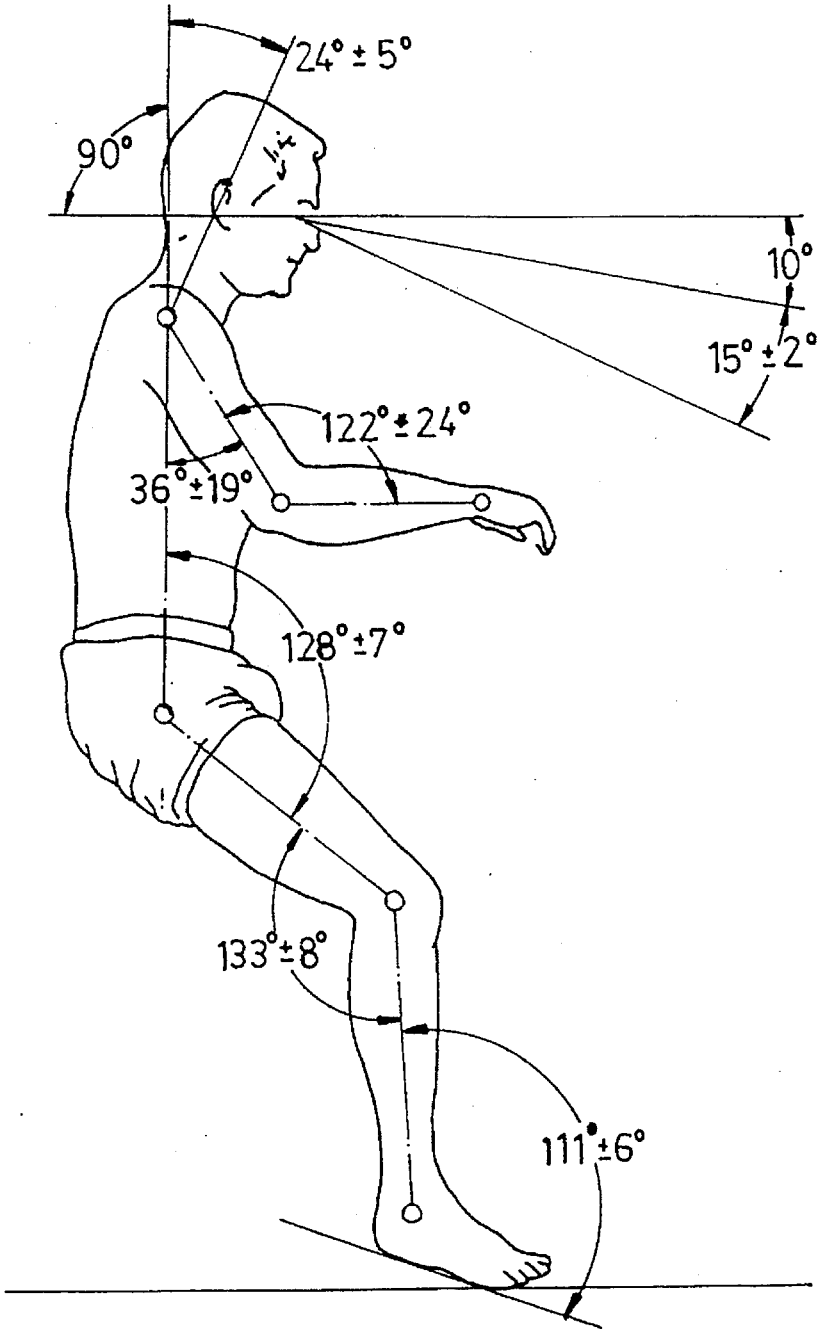
FIG. 5 shows a schematic view of a person in a resting posture under zero-gravity conditions.
Figure 6A:
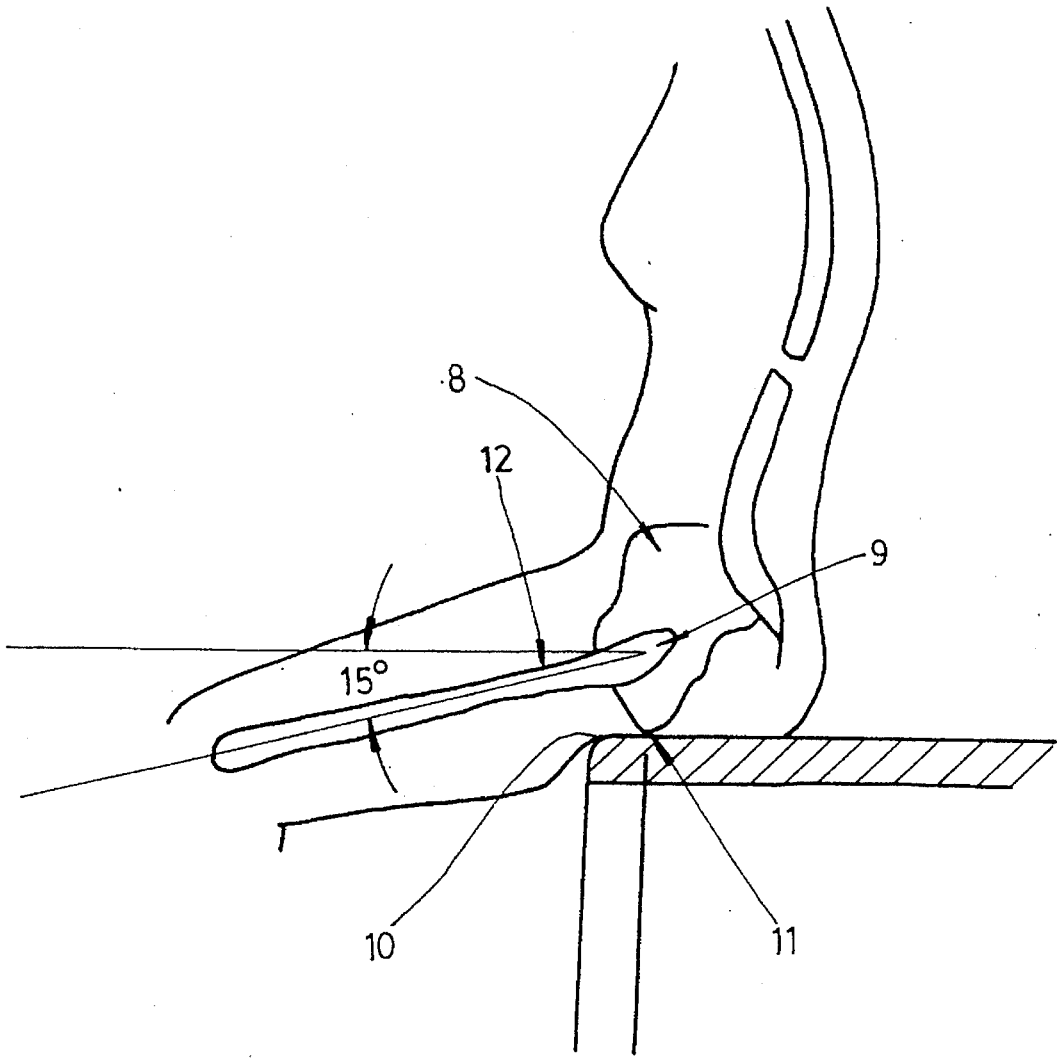
FIGS. 6*a* and 6*b* are schematic views showing the relative positions of a chair and the gluteal fold and the ischial tuberosity of a person in a high sitting posture.
Figure 6B:
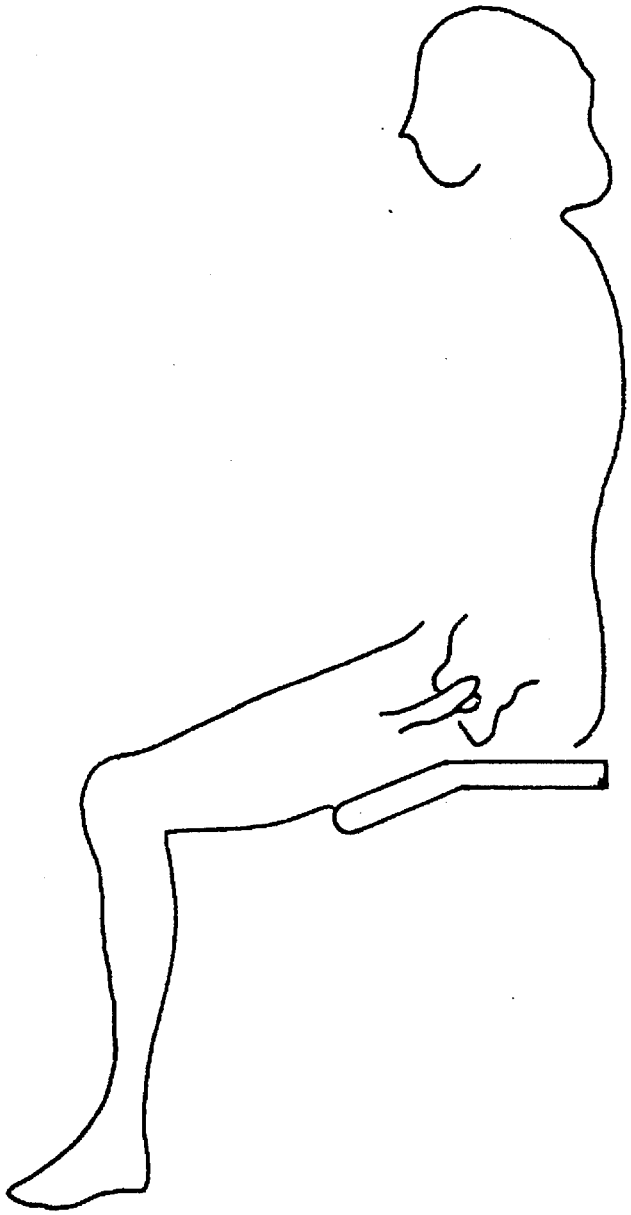
Figure 7:
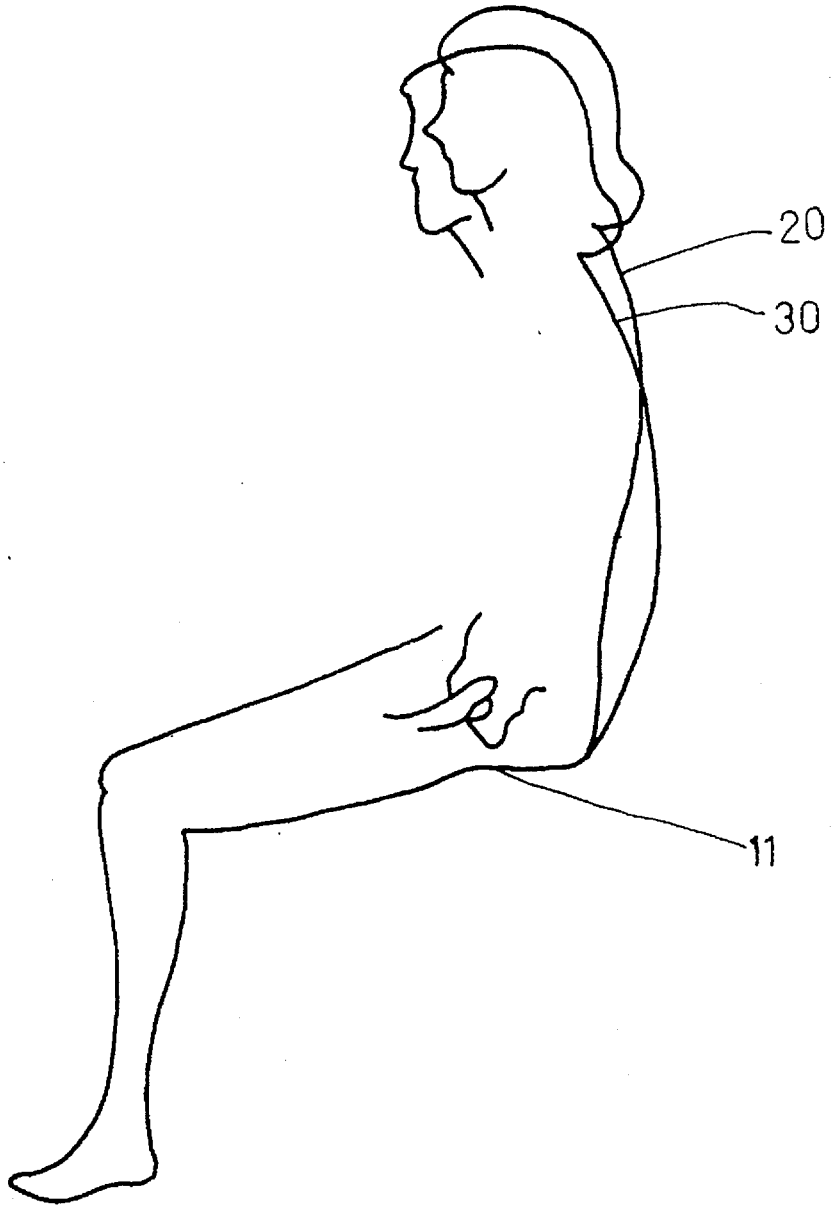
FIG. 7 is a schematic view showing the influence that the sitting postures have on the spinal curvature, the vertical height and the horizontal distance.
Figure 8:
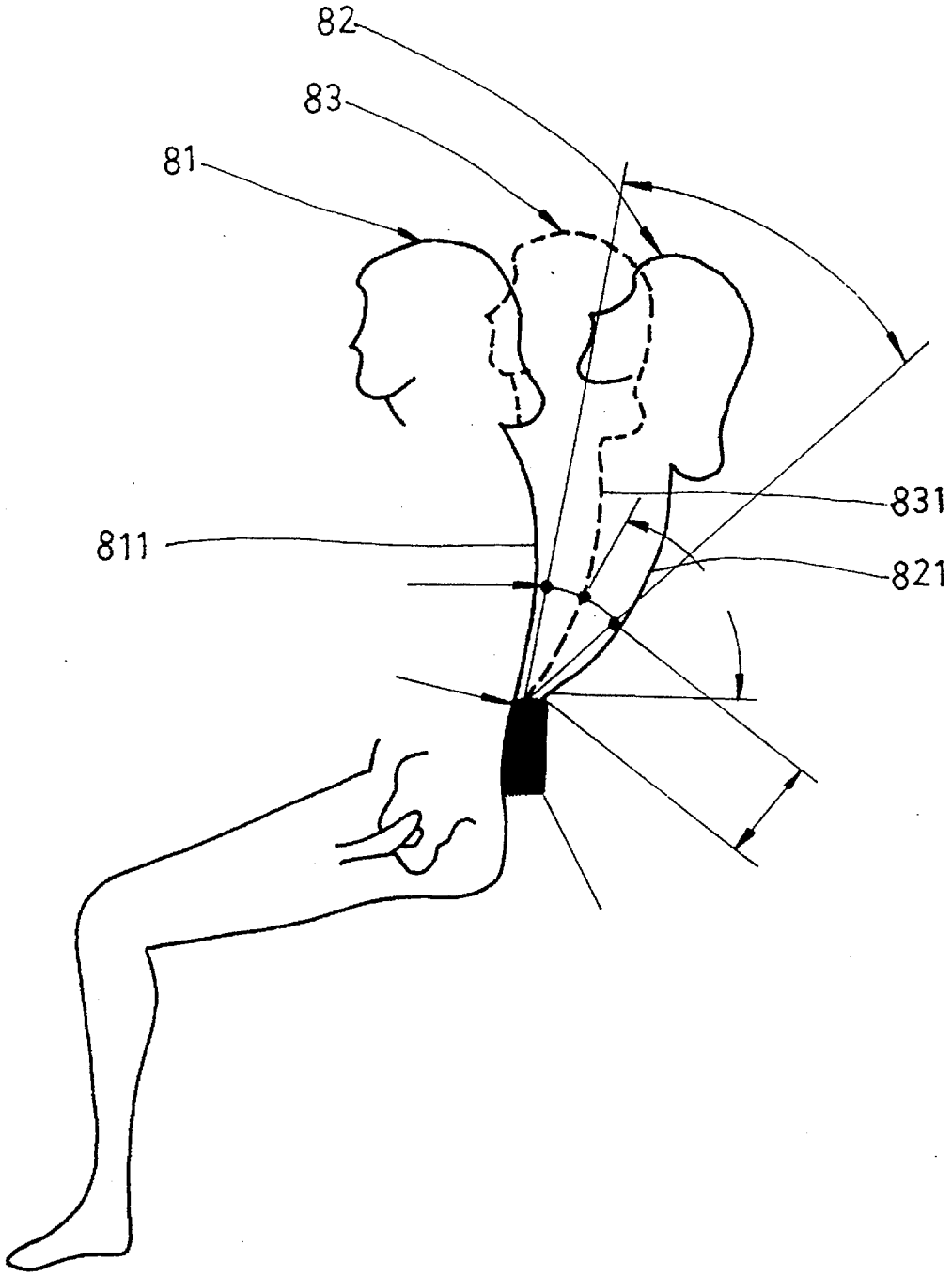
FIG. 8 is a schematic view showing an erect sitting posture, a semi-extended sitting posture and a fully extended sitting posture.
Figure 9:
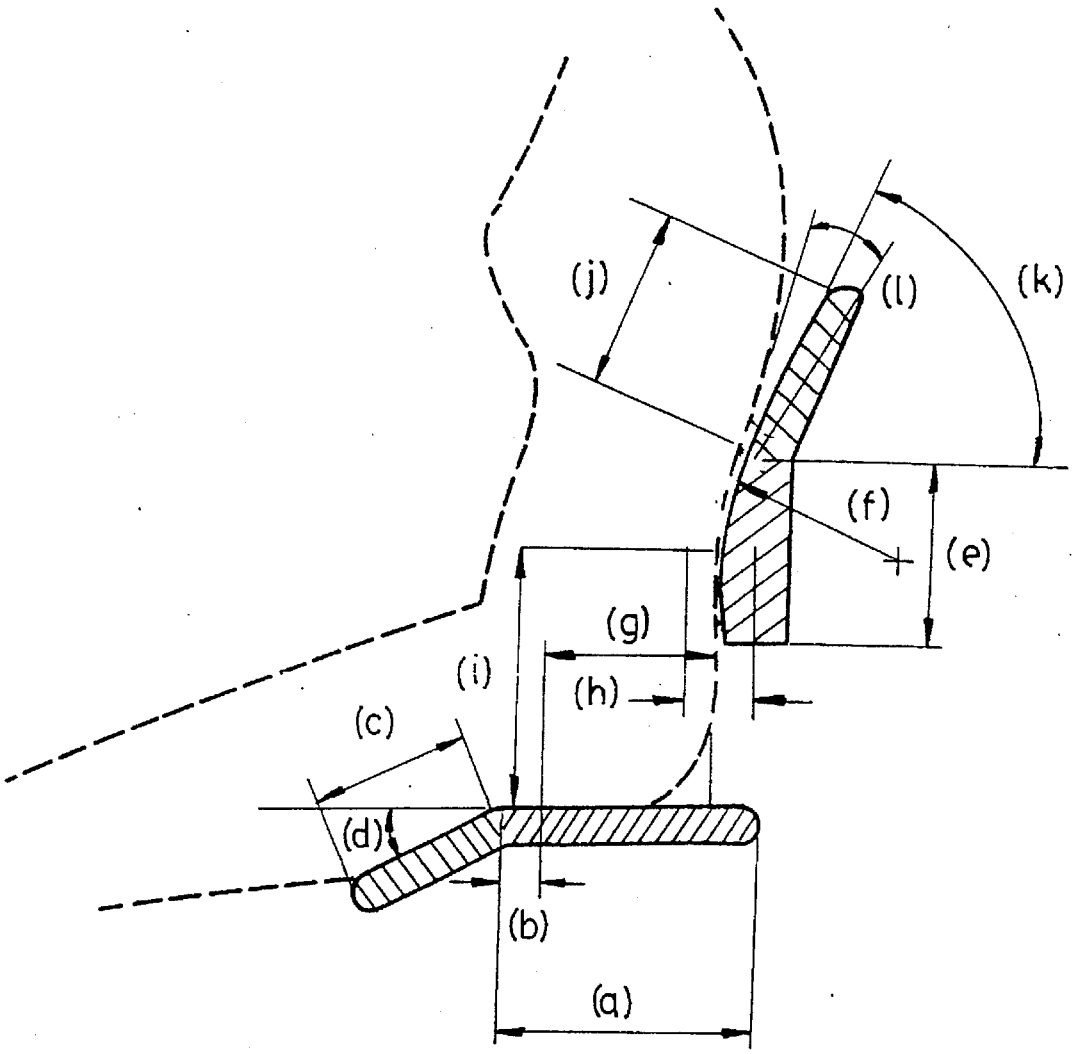
FIG. 9 is a schematic view showing twelve basic measurements for of designing a work chair of the present invention.
Figure 10:
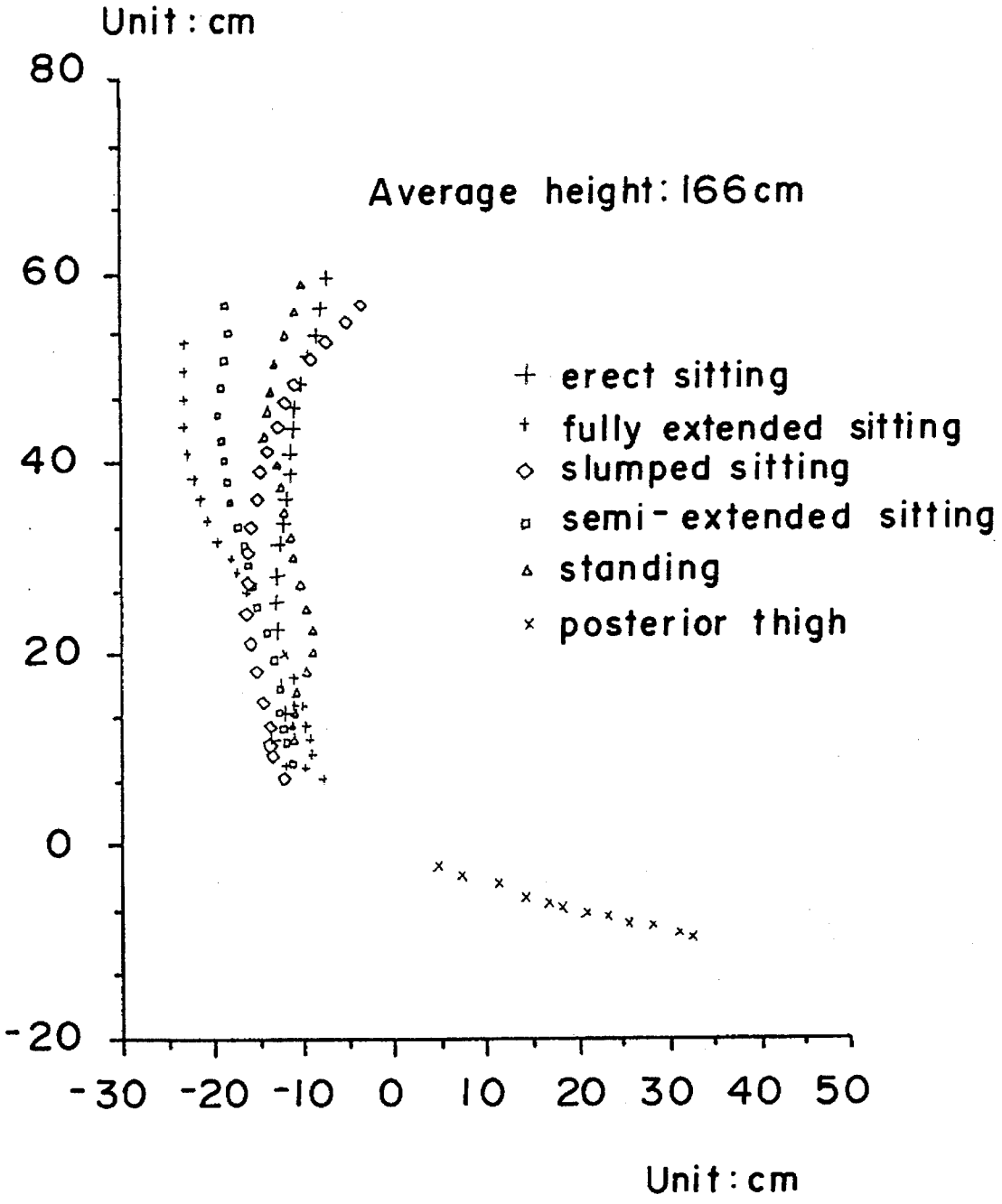
FIG. 10 is a schematic view showing a coordinate of five spinal curves and posterior thigh curves.
Figure 11:
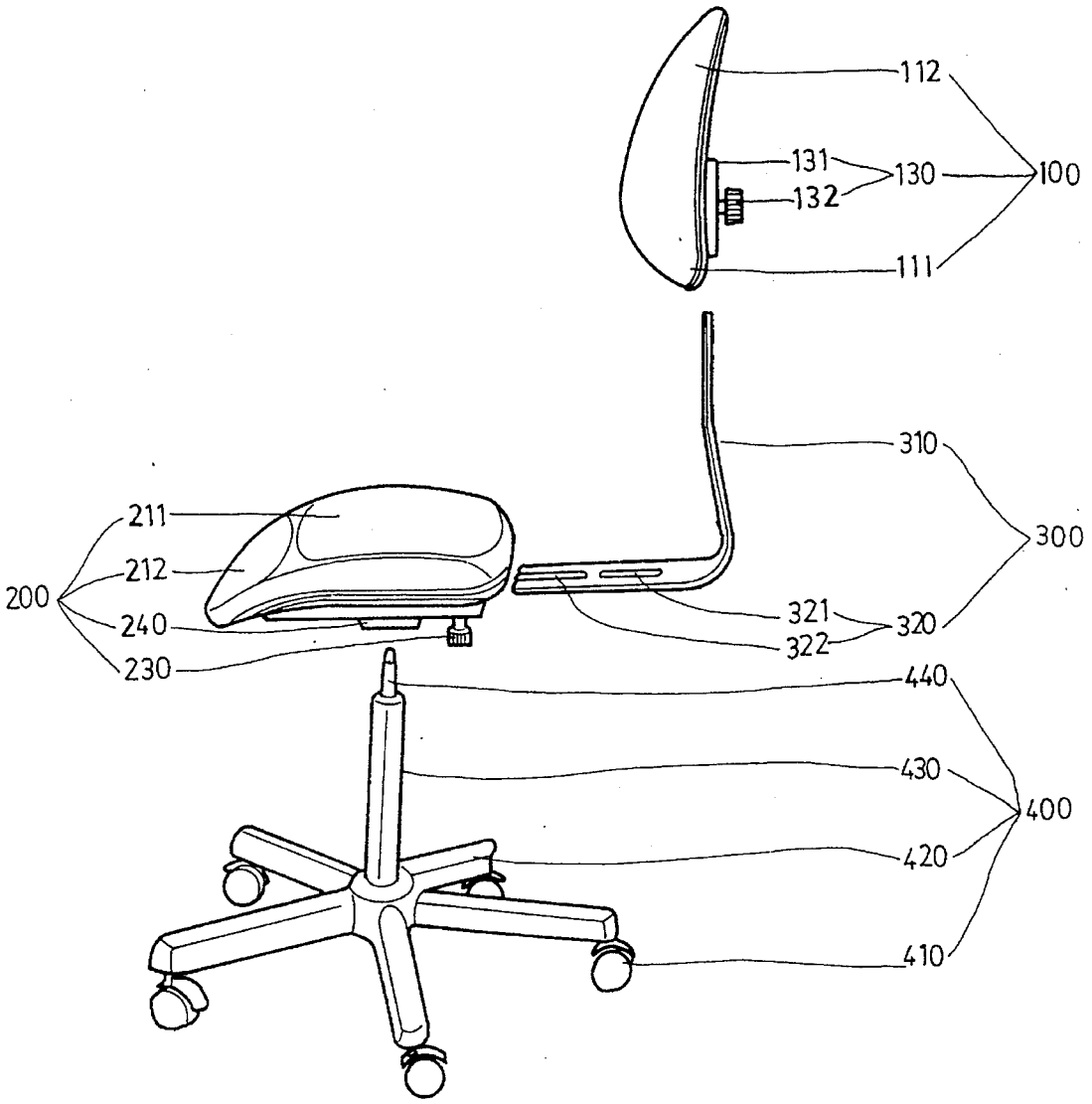
FIG. 11 shows an exploded view of a work chair of the present invention.
Figure 13:
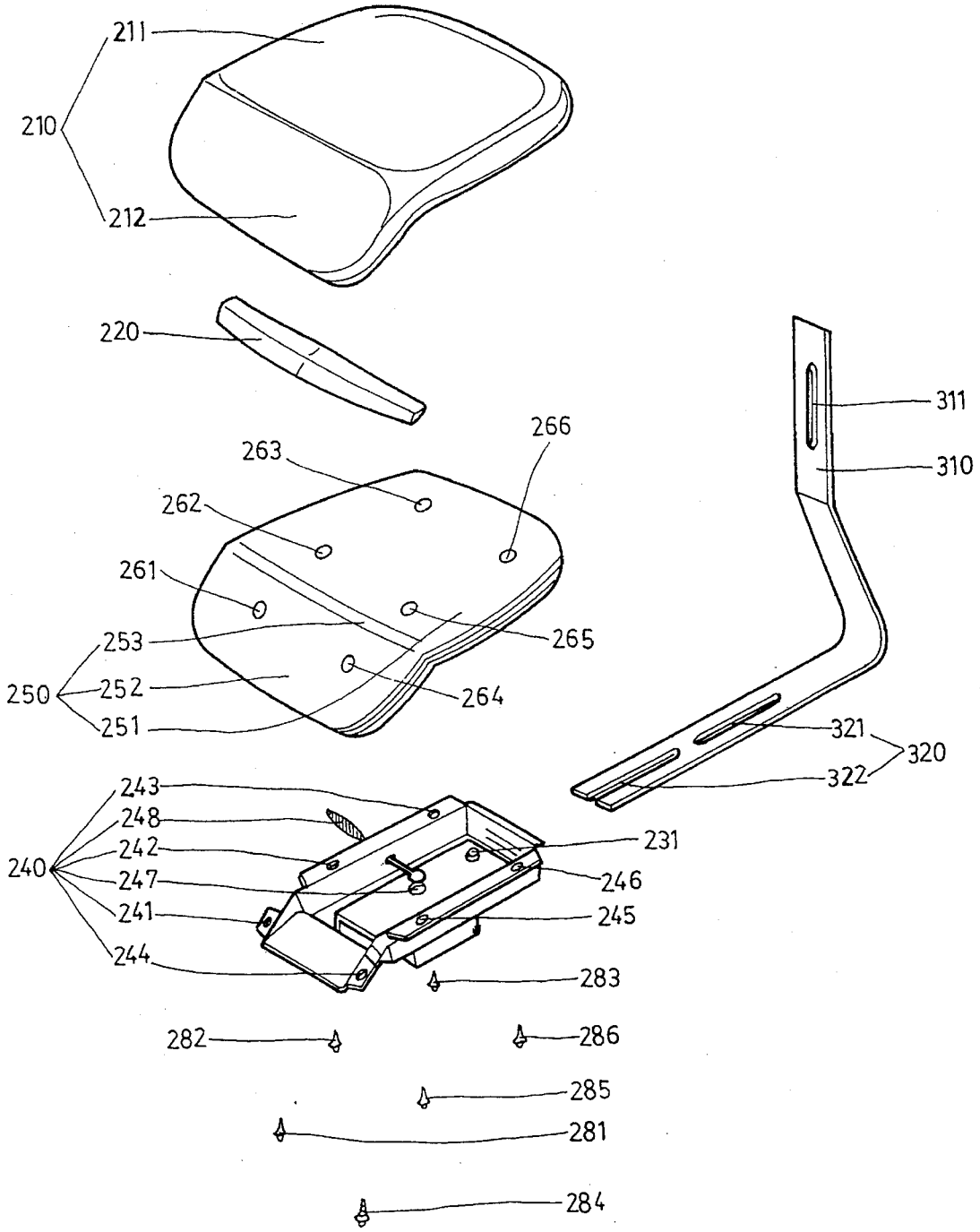
FIG. 13 shows an exploded view of the seat-pan and the fastening mechanism of the work chair of the present invention.
Figure 15:
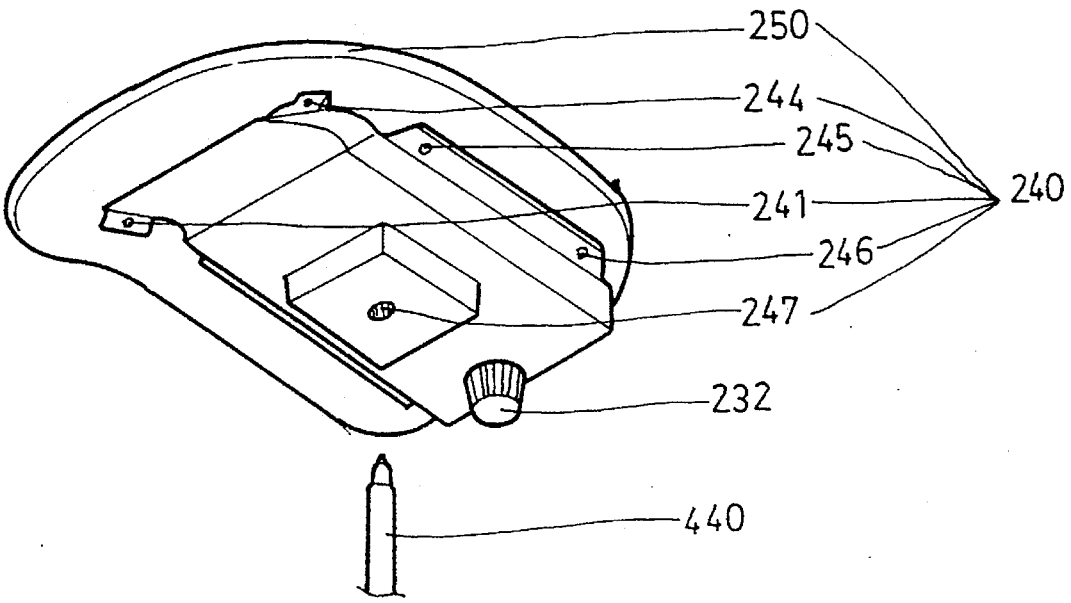
FIG. 15 shows an exploded view of the seat-pan and the support leg of the work chair as shown in FIG. 11.

As shown in FIG. 11, a work chair embodied in the present invention comprises a backrest 100 which is made up of a lumbar support 111, a thoracic support 112 and a first fastening means 130. The first fastening means 130 comprises a backrest fastening seat 131 and a fastening screw 132. The lumbar support 111 is of an arcuate construction. The thoracic support 112 forms with the plummet a extendedangle of 25 degrees or so. The seat-pan 200 is composed of a pelvic support 211, an thigh support 212, a second fastening means 230, and a rotary fastening unit 240. The fastening mechanism 300 comprises a vertical fastening portion 310 and a horizontal fastening portion 320 which has two distance adjustment holes 321 and 322. The support leg 400 comprises casters 410, a clawlike leg seat 420, a bracing rod 430, and a fastening rod 440. The backrest 100 can be adjusted upwards and downwards by the level adjustment member which is composed of the first fastening means 130 of the backrest 100 and the vertical fastening portion 310 of the fastening mechanism 300. The second fastening means 230 of the seat-pan 200 and the horizontal fastening portion 320 of the fastening mechanism 300 form a longitudinal depth adjustment member for adjusting the longitudinal depth of the seat-pan 200 in relation to the backrest 100, as shown in FIG. 13. The fastening rod 440 of the support leg 400 is engageable with the rotary fastening unit 240 of the seat-pan 200, as shown in FIG. 15.

Figure 12:
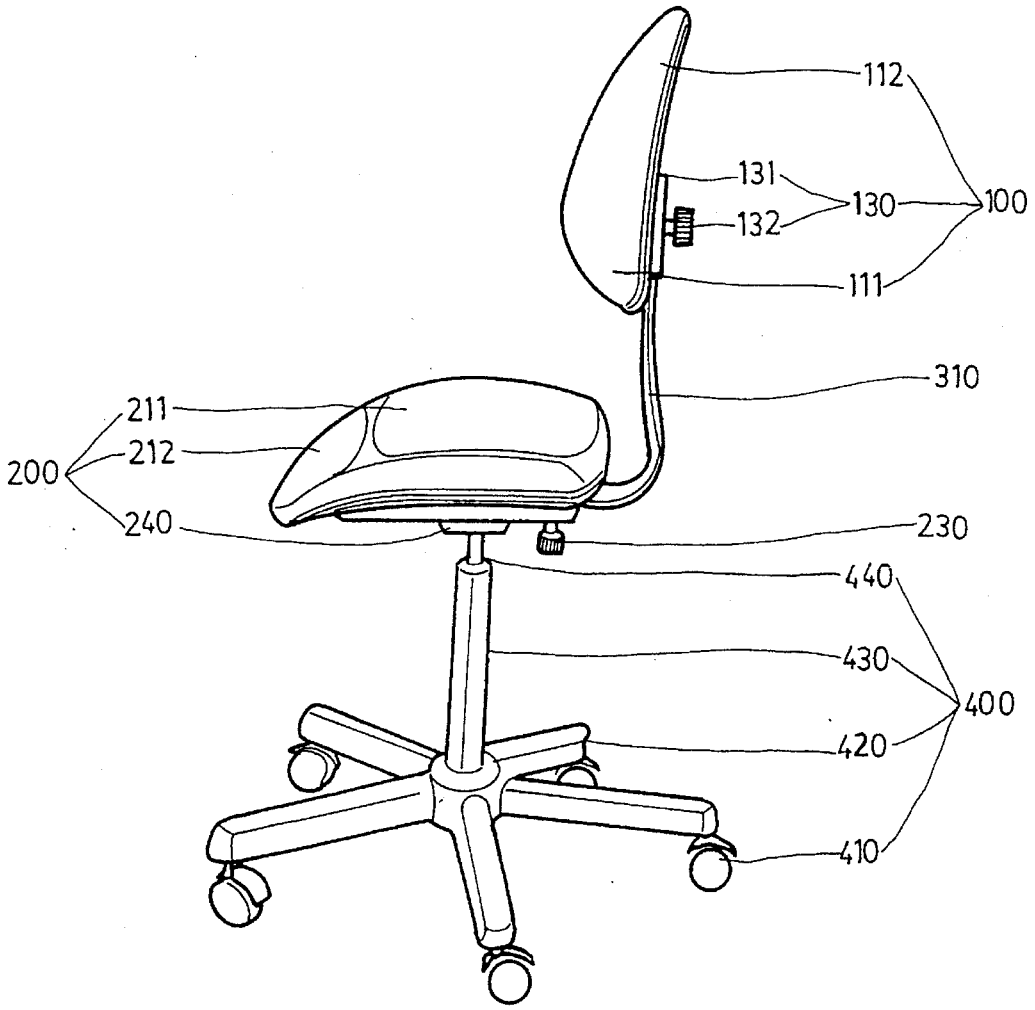
FIG. 12 shows a schematic view of the work chair assembled according to the present invention.

FIG. 12 shows a schematic view of the assembled work chair illustrated in FIG. 11. The reference numerals of FIG. 12 are similar in definition to the like reference numerals of FIG. 11.

The reference numerals of 211, 212, 230, 240, 320, 321 and 310 of FIG. 13 are similar in definition to the like reference numerals of FIG. 11. The thigh support 212 and the pelvic support 211 are made integrally of an elastic material 210. 220 is the reference numeral of an anti-skidding baffle. 250 is a seat-pan supporting plate made integrally of a plate material. 251, 252, 253 are respectively the pelvic support plate, the thigh support plate and the baffle fastening surface. 262, 263, 265, 266 are the threaded holes of the pelvic support plate 251. 261 and 264 are threaded holes of the thigh support plate 252. The pelvic support plate 251 is intended to support the pelvic support 211 of the elastic material 210. The thigh support plate 252 is used to support the thigh support 212 of the elastic material 210. The baffle fastening surface 253 and the anti-skidding baffle 220 form the anti-skidding mechanism. The rotary fastening unit 240 has threaded holes 241, 242, 243, 244, 245 and 246 which correspond in location respectively with the threaded holes 261, 262, 263, 264, 265 and 266, and are engageable respectively with screws 281, 282, 283, 284, 285 and 286 for fastening the seat-pan supporting plate 250 with the rotary fastening unit 240. After fastening the anti-skidding baffle, the elastic material 210 is adhered. The connection hole 247 is used to fasten the support leg 400. 248 is the control rod for adjusting the height of the seat-pan 200 in relation to the clawlike leg seat 420. 231 is a connection hole engageable with a screw 232 to form the second fastening means 230. The horizontal fastening portion 320 has a distance adjustment hole 322 engageable with the fastening rod 440 which is also engageable with the connection hole 247. The horizontal fastening portion 320 further has a distance adjustment hole 321 engageable with a screw 232 which is engaged with the connection hole 231.

Figure 14:
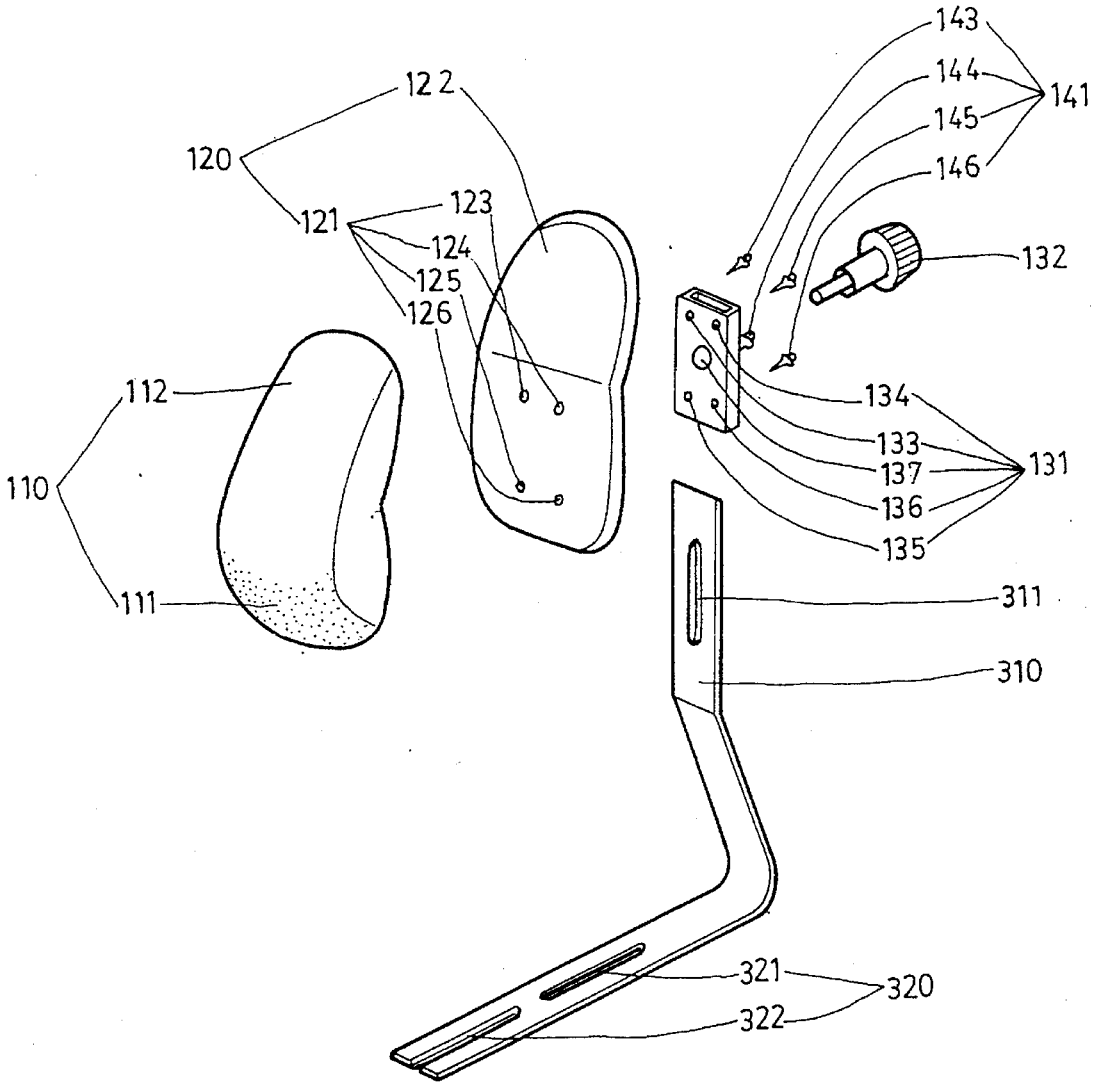
FIG. 14 shows an exploded view of the backrest and the fastening mechanism of the work chair of the present invention.

The reference numerals of 111, 112, 131, and 132 of FIG. 14 are similar in definition to the like reference numerals of FIG. 11. The lumbar support 111 and the thoracic support 112 are made integrally of the elastic material 110. 120 is a backrest supporting plate made of a plate material. The lumbar support plate 121 and the thoracic support plate 122 are intended respectively to support the lumbar support 111 and the thoracic support 112. 123, 124, 125 and 126 are threaded holes of the lumbar support plate 121. 133, 134, 135 and 136 are threaded holes of the backrest fastening seat 131. The fastening screws 143, 144, 145 and 146 are engageable with the threaded holes 133(123), 134(124), 135(125), and 136(126) for fastening the backrest fastening seat 131 with the backrest supporting plate 120. The elastic material 110 is adhered thereto thereafter. The connection hole 137 of the backrest fastening seat 131 is engageable with the screw 132. The distance adjustment hole 311 is engageable with the screw 132 for adjusting the level of the backrest 100 in relation to the seat-pan.

The reference numerals of 232, 240, 241, 244, 245, 246, 247, and 440 of FIG. 15 are similar in definition to the like reference numerals of FIGS. 11–14. FIG. 15 illustrates a perspective bottom view of the seat-pan supporting plate 250 which is fastened with the rotary fastening member 440 of the support leg.

Figure 16:
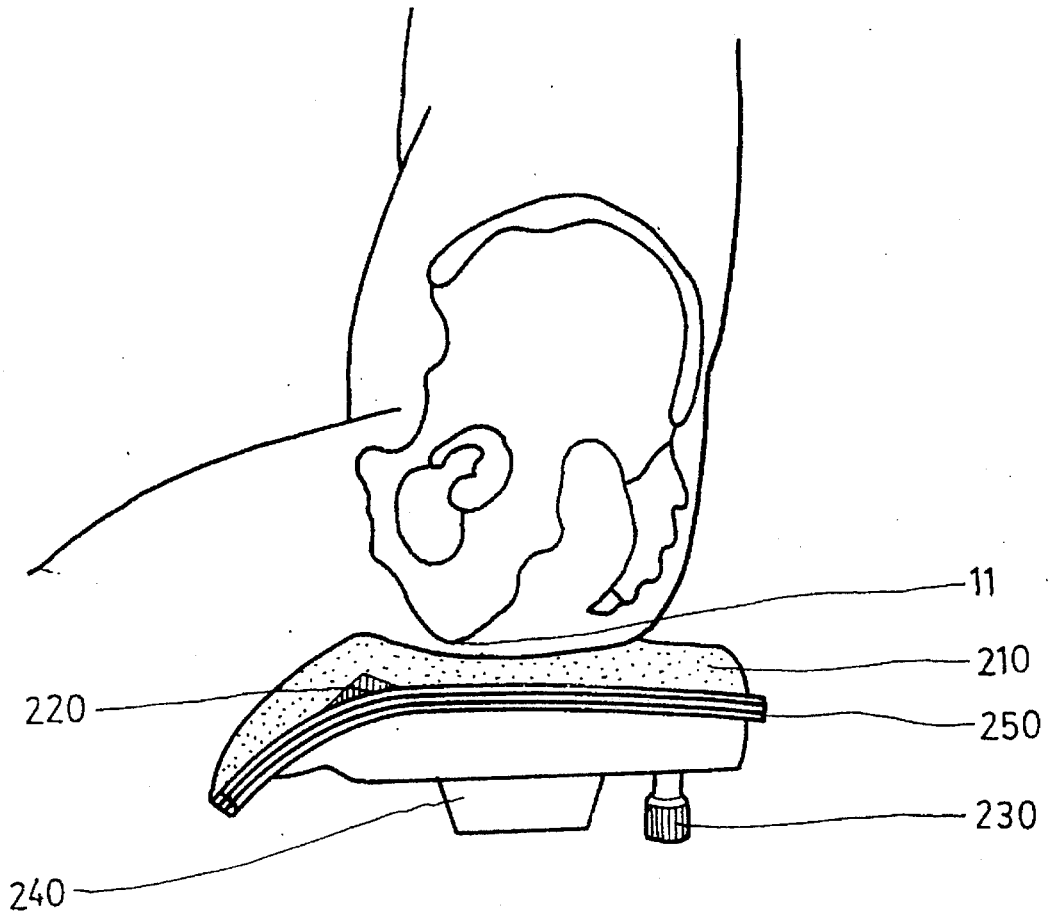
FIG. 16 is a schematic view of a sitting posture of a person sitting on the work chair of the present invention at work.

The reference numerals of FIG. 16 are similar in definition to the like reference numerals of FIGS. 11–15. As shown in FIG. 16, the ischial tuberosity 11 of a person in a sitting posture is about 3 centimeters away from the front edge of the hip supporting area. In the meantime, the posterior thigh curve remains at an inclination of 20 degrees. As a result, the pressure in the vicinity of the gluteal fold is dispersed effectively so as to prevent the lower limbs of the person from becoming numb.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

TABLE 1

| measurements/items | average values | standard deviations | percentile fifth | percentile fiftieth | percentile ninety fifth | recommended sizes | |
|---|---|---|---|---|---|---|---|
| (a) depth-pelvic support | 16.1 | 0.5 | 15.3 | 16.0 | 16.8 | 95th | 16.8 |
| (b) location-ischial tuberosity | 4.1 | 0.6 | 3.0 | 4.1 | 4.8 | 50th | 4.1 |
| (c) depth-thigh support | 14.5 | 0.8 | 13.3 | 14.6 | 15.8 | 50th | 14.6 |
| (d) angle-thigh support | −24.3 | 0.7 | −23.2 | −24.2 | −25.3 | 50th | −24.2 |
| (e) V. lenght-lumb support | 12.7 | 0.5 | 12.1 | 12.9 | 13.7 | 50th | 12.9 |
| (f) radius-lumb support | 74.8 | 12.3 | 23.6 | 35.2 | 163.7 | 5th | 23.6 |
| (g) H. distance-lumb support | 12.7 | 0.4 | 12.1 | 12.8 | 13.4 | 50th | 12.8 |
| (h) H. adjustment-lumb support | 4.0 | 0.5 | 3.3 | 4.1 | 4.9 | 95th | 4.9 |
| (i) V. height-lumb support | 24.6 | 0.5 | 23.9 | 24.7 | 25.4 | 50th | 24.7 |
| (j) V. lenght-thor. support | 13.7 | 0.6 | 12.9 | 13.8 | 14.6 | 5th | 13.8 |
| (k) angle-thor. support | 74.1 | 1.1 | 72.5 | 74.2 | 75.9 | 50th | 74.2 |
| (l) angle adjustment-thor. support | 25.2 | 1.6 | 22.4 | 25.1 | 27.9 | 95th | 27.9 |

What is claimed is:

1. A work chair comprising:

a backrest provided on a back thereof with a first fastening means;

a seat-pan comprising a pelvic support portion having a support surface and a thigh support portion said pelvic support portion provided on a underside thereof with a first rotary fastening means and further provided with a second fastening means located axially thereof;

a fastening mechanism comprising a vertical fastening means engageable with said first fastening means of said backrest, said fastening mechanism further comprising a horizontal fastening means engageable with said second fastening means of said seat-pan, said vertical fastening means and said horizontal fastening means forming an angle of between 85 and 95 degrees;

a chair support leg provided on a top thereof with a second rotary fastening means engageable with said first rotary fastening means of said seat-pan; and, an anti-skid baffle extending above the support surface and located on the seat pan adjacent to the juncture of the pelvic support portion and the thigh support portion, whereby said first fastening means of said backrest and said vertical fastening means of said fastening mechanism form an adjustment means for adjusting said backrest upwards and downwards, relative to said vertical fastening means; said second fastening means of said seat-pan and said horizontal fastening means of said fastening mechanism form a longitudinal adjusting means for adjusting a longitudinal position of said seat-pan relative to said horizontal fastening means, said backrest having and arcuate front side, said thigh support portion of said seat-pan forms an angle between 15 and 35 degrees with said pelvic support portion.

2. The work chair as claimed in claim 1, wherein said seat-pan is fastened rotatably with respect to said chair support leg such that said seat-pan can be rotated relative to the chair support leg.

3. The work chair as claimed in claim 1, wherein said backrest has a height of between 20 and 40 centimeters; said seat-pan has a longitudinal length between 15 and 30 centimeters; and wherein said support leg has a length of between 40 and 60 centimeters.

4. The work chair as claimed in claim 1, wherein said backrest has a maximum lateral width between 15 and 30 centimeters and a maximum height of between 20 and 40 centimeters.

5. The work chair as claimed in claim 3, wherein said backrest has a maximum lateral width between 15 and 30 centimeters and a maximum length of between 20 and 40 centimeters.

* * * * *